United States Patent [19]

Honegger et al.

[11] Patent Number: 4,757,842

[45] Date of Patent: Jul. 19, 1988

[54] LOOM FRAME

[75] Inventors: Rolf Honegger, Durnten; Georg Senn, Ruti, both of Switzerland

[73] Assignee: Sulzer Brothers Limited, Winterthur, Switzerland

[21] Appl. No.: 55,154

[22] Filed: May 28, 1987

[30] Foreign Application Priority Data

May 29, 1986 [CH] Switzerland ..... 02165/86

[51] Int. Cl.[4] ..... D03D 49/02

[52] U.S. Cl. ..... 139/1 R

[58] Field of Search ..... 139/1 R, 97, 292 R, 139/302, 29, 34

[56] References Cited

U.S. PATENT DOCUMENTS

| | | | |
|---|---|---|---|
| 605,507 | 6/1898 | Newcomb | 139/29 |
| 2,489,557 | 11/1949 | Blanchard . | |
| 2,619,989 | 12/1952 | Sargent | 139/33 |
| 3,858,619 | 1/1975 | Berry | 139/1 R |

FOREIGN PATENT DOCUMENTS 3026450 11/1982 Fed. Rep. of Germany .

*Primary Examiner*—Henry Jaudon

*Attorney, Agent, or Firm*—Burns, Doane, Swecker & Mathis

[57] ABSTRACT

A loom frame comprises side wall assemblies (9) on the narrow sides of the loom (1) and cross-members (13–16) interconnecting the side wall assemblies (9) and extending parallel to the long sides of the loom. The side walls (9) of the frame (8) are each in at least two parts (10, 11) secured to one another by at least one connecting bar (12). The same side wall parts (10, 11), but different connecting bars (12), flanges (121, 122, 125) and rests (123, 124) can be used to construct different loom frames. Different frames can therefore be produced at reasonable manufacturing costs from just a few variable parts.

6 Claims, 3 Drawing Sheets

LOOM FRAME

FIELD OF THE INVENTION

The invention relates to a loom frame construction which includes side wall assemblies on the narrow sides of the loom and cross-members interconnecting the side wall assemblies. The side wall assemblies are made up of components that may be standardized to a substantial extent and that may be brought together in different arrangements to accommodate different dimensional requirements associated with a family of looms.

BACKGROUND OF THE INVENTION

A frame of this kind is disclosed, for example, in U. S. Pat. No. 2,533,128, a loom frame in which the side walls are large-area joined-together parts each supported on the floor by two feet and which carry a number of operative elements of the loom. Side walls of this kind help to provide good stability of the loom but are expensive to produce. If the walls are castings, large casting molds and machining facilities must be used. If the walls are welded, the consumption of material is relatively substantial and production time is correspondingly lengthy. To be able to produce side walls of this kind for different kinds of looms, different molds are required for cast walls or a large number of different components are required for welded walls. These considerations make it relatively costly to produce a standard series of looms.

SUMMARY OF THE INVENTION

It is an object of this invention to provide a loom frame which can be produced with a relatively reduced outlay on material and production and which can be built up to different dimensions from a reduced number of variable components.

According to the invention, the side walls of a frame are assemblies each embodied in at least two parts which are disposed on at least one connecting bar. The connecting bar can be arranged as a foot or bottom bar below the parts forming the side wall. One part of a side wall can be operative, for example, just to carry the warp beam and the drive therefor. Flanges or supports to receive the parts of a side wall assembly are secured to a connecting bar.

The loom frame also includes cross-members in the form of rigid steel sections with flanges at their ends, which flanges are screwed to the side wall parts and possibly to the connecting bars too.

Frames of different sizes can be devised from identical side wall parts by using with these standardized parts, connecting bars of different sizes and flanges and supports of different characteristics. The invention makes it possible to produce loom frames of different sizes at a reasonable cost.

BRIEF DESCRIPTION OF THE DRAWINGS

The invention will be described in detail hereinafter with reference to the drawings wherein.

DETAILED DESCRIPTION OF PREFERRED EMBODIMENTS

Figure 1:
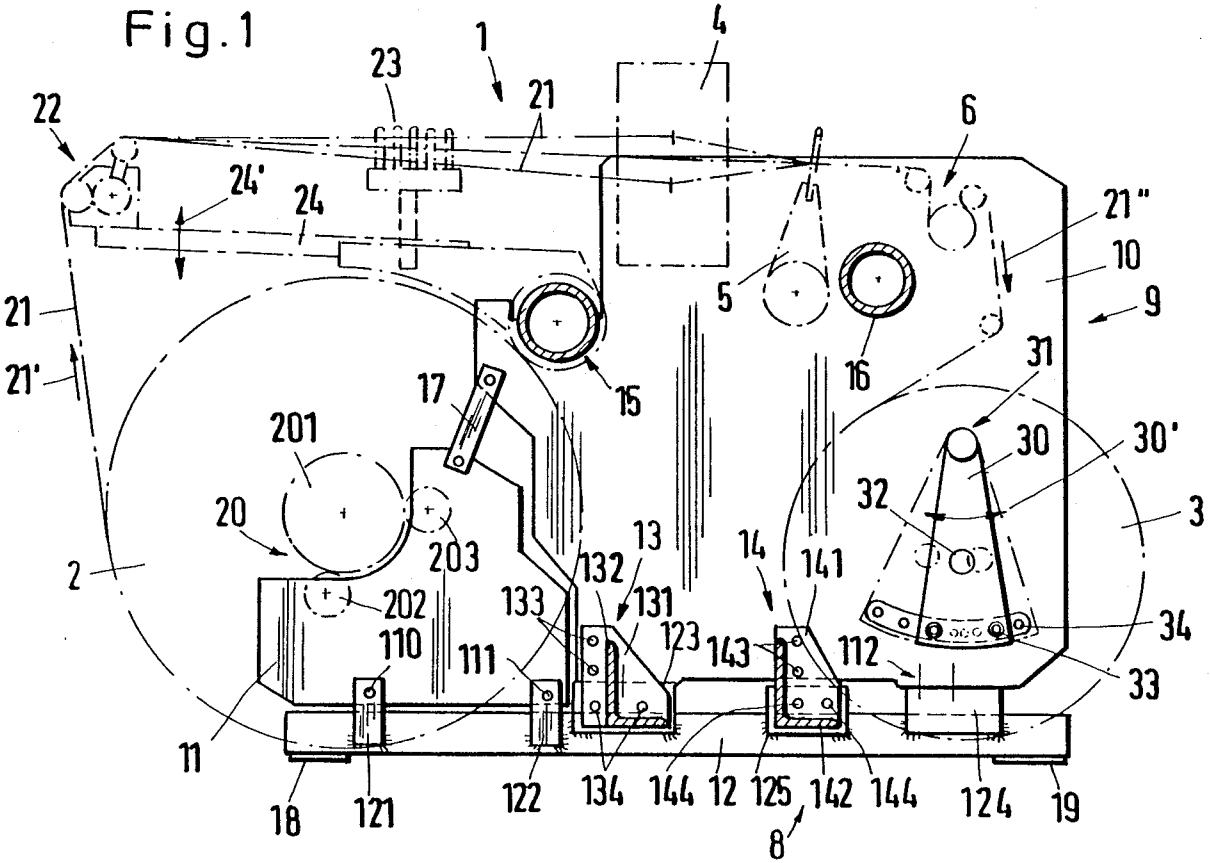
FIG. 1 is a cross-section through a loom having a frame according to the invention.

A warp beam 2, cloth beam 3, warp shedding means 4, a sley 5 and a cloth take-off 6 are mounted on a frame 8 of a loom 1. Frame 8 is embodied by side walls 9 and, interconnecting the same, cross-bearers or cross-members 13, 14 and cross-tubes 15, 16. A warp yarn jockey 22 and a warp yarn detector 23 for guiding warp yarns 21 are disposed on a carrying arm 24 movable, as indicated by a double arrow 24', around the center of tube 15.

The finished cloth is taken off by means of the device 6 to cloth beam 3. The cloth beam 3 is mounted on an end plate 30 which is adjustable around a pivot 31, the end plate 30 being in outline substantially triangular and being mounted in a bearing 32. The end plate 30 can be secured by screwed fasteners 33 in different tapped apertures 34 in side wall 9.

The warp yarns move in a direction indicated by an arrow 21' and the cloth moves in a direction indicated by arrows 21''. A warp beam tube 201 is disposed at the center of the warp beam 2 and runs on rollers 202, 203 in warp beam bearing 20. The drives for the elements 2–4, etc. are not shown and can be devised, for example, as set out in U.S. Pat. No. 2 533 128.

Each of the side wall 9 is an assembly which comprises a first part, in the form of an end plate 10, a second part, in the form of a bearing plate 11, and a connecting bar 12. Further strengthening or propping elements, such as the illustrated link 17, can be provided between the various parts in order to strengthen the side walls. As FIG. 1 shows, the bar 12 carries upstanding flanges (i.e., upright connector members) 121, 122, and 125, as well as rests or support members 123 and 124 having generally horizontal bearing surfaces. The plate 11 is screwed by way of the flanges 121, 122 to the bar 12, and the plate 10 is disposed on the rests 123, 124. The parts are interconnected by screw-threaded fastenings 110, 111, and 112.

The cross-members 13 and 14 comprise flanges 131 and 141 respectively and steel sections 132 and 142 respectively. The flanges 131, 141 are connected by screws 133, 143 respectively to the plate 10. Also, the flanges 131, 141 are connected to the rest 123 and flange 125 respectively by respective screws 134, 144. The multiple screw-threaded fastenings between the parts ensure that the frame 8 is very stable. Feet 18, 19 of the loom are disposed below the bar 12 in FIG. 1.

Figure 2:
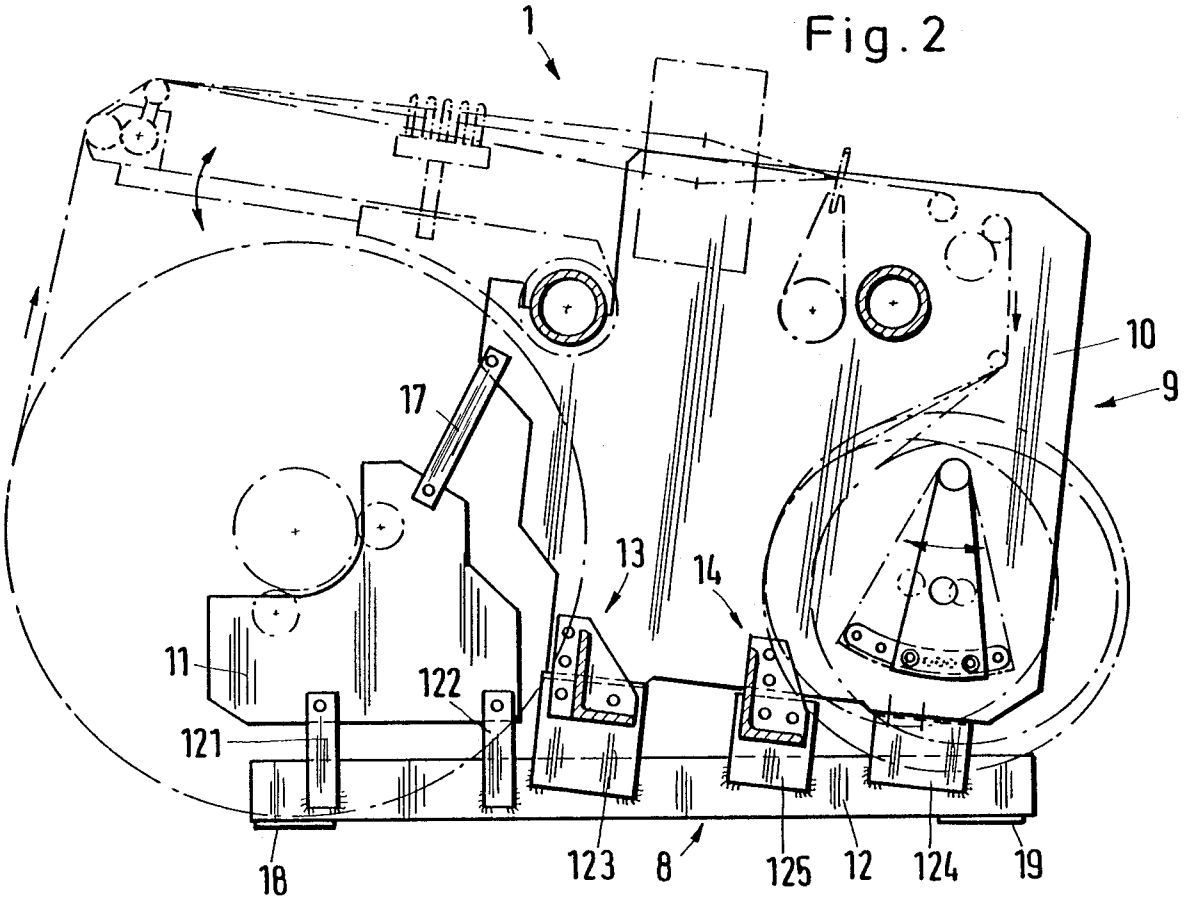
FIG. 2 shows a similar loom having an enlarged frame using the same side wall parts.

FIG. 2 is a view in cross-section of a similar loom using only a few different parts from those used in the embodiment shown in FIG. 1. These different parts are the flanges 121, 122, 125 and the rests 123, 124. Also different link 17 and a longer connecting bar are required. This loom can receive larger warp beams than the loom of FIG. 1. As will be apparent from a comparison between FIGS. 1 and 2, the size and appearance of the loom can be altered substantially just by devising differently the connecting parts between the bar 12 and the plates 10 and 11.

The connecting bars 12 of a loom as shown in FIGS. 1 and 2 have the same structure. To reduce noise they can be made of plastics, for example, polymer concrete. In this case the flanges 121, 122, 125 and rests 123, 124 should be cast in the plastic.

Figure 3:
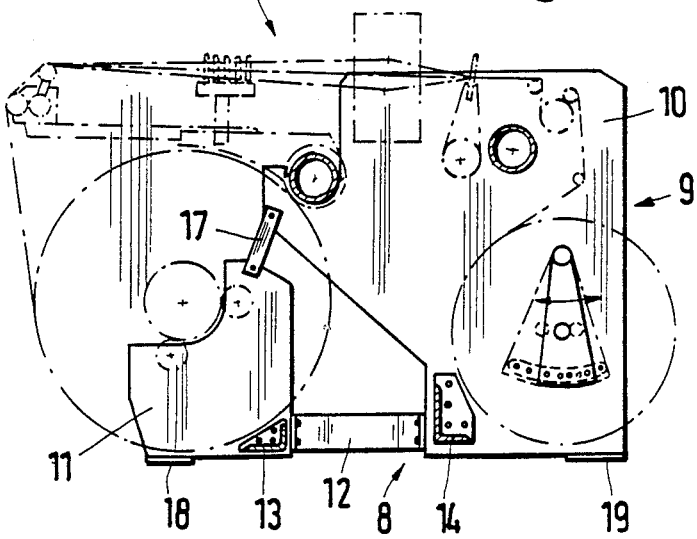
FIG. 3 is a view in cross-section to a reduced scale of another embodiment of a loom frame according to the invention.
Figure 4:
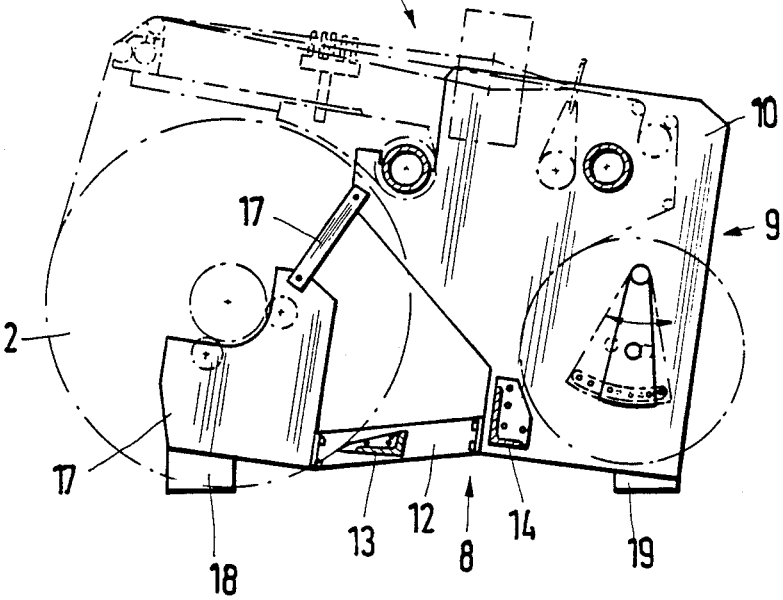
FIG. 4 shows another loom frame similar to that of FIG. 3.

FIGS. 3 and 4 show two other loom embodiments wherein only the bars 12, feet 18 and 19, links 17 and the arrangements of the cross-member 13 differ from one another. In these embodiments the loom bears directly by way of the plates 10 and 11 on the feet 19, 18 respectively. In the embodiment shown in FIG. 4 the cross-member 13 must be screwed to the connecting bars 12 because of the outermost periphery of the warp beam 2. All the other components can be identical for the two embodiments shown in FIGS. 3 and 4.

What is claimed is:

1. A loom frame comprising side wall assemblies on the narrow sides of the loom and cross-members interconnecting said side wall assemblies and extending parallel to the long sides of the loom, each of said side wall assemblies comprising at least two parts which are disposed on at least one connecting bar means, said connecting bar means including upstanding flanges to interconnect said connecting bar means and one of said side walls in the desired spacial relation to one another, and the connecting bar means further including support members having upper bearing surfaces to permit the other side wall parts to rest thereon.

2. A frame according to claim 1, wherein one of said side wall parts of each side wall assembly is devised as an end bearing plate for the warp beam of the loom.

3. A frame according to claim 2, wherein the other said side wall parts of each side wall assembly is designed to carry the weight of the cloth beam of the loom.

4. A loom frame construction for a loom having a warp beam, warp shedding means, a sley and a cloth beam; said frame including two side wall assemblies and cross-members interconnecting said side wall assemblies; each of said side wall assemblies comprising a first plate member cooperating with the first plate member of the other side wall assembly for carrying said warp beam, a second plate member spaced from said first plate member and cooperating with the second plate member of the other side wall assembly for carrying said cloth beam and said warp shedding means and said sley, a connecting bar, and means rigidly connecting said connecting bar to both said first plate member and said second plate member.

5. A loom frame construction according to claim 4, wherein said connecting bar is formed of plastic material.

6. A loom frame construction according to claim 4, wherein said connecting bar is formed of polymer concrete.

* * * * *